US008959970B2

(12) United States Patent
Austen

(10) Patent No.: US 8,959,970 B2
(45) Date of Patent: Feb. 24, 2015

(54) METHOD AND APPARATUS FOR APPLYING UNIAXIAL COMPRESSION STRESSES TO A MOVING WIRE

(76) Inventor: Alfred R. Austen, Bath, PA (US)

( * ) Notice: Subject to any disclaimer, the term of this patent is extended or adjusted under 35 U.S.C. 154(b) by 229 days.

(21) Appl. No.: 13/476,595

(22) Filed: May 21, 2012

(65) Prior Publication Data

US 2012/0247167 A1 Oct. 4, 2012

Related U.S. Application Data

(63) Continuation of application No. 12/830,897, filed on Jul. 6, 2010, now Pat. No. 8,534,108.

(51) Int. Cl.

| | |
|---|---|
| ***B21C 23/00*** | (2006.01) |
| ***B21D 43/00*** | (2006.01) |
| ***H01L 39/24*** | (2006.01) |
| ***B21C 33/00*** | (2006.01) |
| ***B21C 37/04*** | (2006.01) |
| ***B21F 23/00*** | (2006.01) |

(52) U.S. Cl.

CPC ..... *B21C 23/005* (2013.01); *B21C 33/004* (2013.01); *B21C 37/042* (2013.01); *B21F 23/00* (2013.01); *B21F 23/002* (2013.01); *Y10S 505/928* (2013.01)

USPC ..... 72/256; 72/419; 29/599; 505/433; 505/928

(58) Field of Classification Search

USPC ..... 72/270, 419, 426, 428, 256, 253.1, 271, 72/711; 226/108, 183, 190; 29/599; 505/433, 928, 929

See application file for complete search history.

(56) References Cited

U.S. PATENT DOCUMENTS

| | | | | |
|---|---|---|---|---|
| 2,931,082 | A * | 4/1960 | Brennan et al. | 164/461 |
| 3,731,509 | A | 5/1973 | Fuchs | |
| 3,765,216 | A | 10/1973 | Green | |
| 3,777,964 | A | 12/1973 | Kruner et al. | |
| 3,841,129 | A | 10/1974 | Nogutim et al. | |
| 3,872,703 | A | 3/1975 | Green | |
| 3,922,898 | A | 12/1975 | Voorhes et al. | |
| 3,934,446 | A | 1/1976 | Avitzur | |
| 3,985,011 | A | 10/1976 | Fuchs | |
| 4,094,175 | A | 6/1978 | Pechner | |
| 4,163,377 | A | 8/1979 | Moreau | |
| 4,220,029 | A | 9/1980 | Ahmed et al. | |

(Continued)

FOREIGN PATENT DOCUMENTS

| | | | |
|---|---|---|---|
| JP | 60026576 | A | 2/1985 |
| JP | 03275213 | A | 12/1991 |

OTHER PUBLICATIONS

European Patent Office; The International Search Report and the Written Opinion of the International Searching Authority; Mailed Nov. 14, 2011.

*Primary Examiner* — Teresa M Ekiert
(74) *Attorney, Agent, or Firm* — Design IP

(57) ABSTRACT

An apparatus and method for moving a wire along its own axis against a high resistance to its motion causing a substantial uniaxial compression stress in the wire without allowing it to buckle. The apparatus consists of a wire gripping and moving drive wheel and guide rollers for transporting the moving wire away from the drive wheel. Wire is pressed into a peripheral groove in a relatively large diameter, rotating drive wheel by a set of small diameter rollers arranged along part of the periphery causing the wire to be gripped by the groove.

5 Claims, 6 Drawing Sheets

(56) References Cited

U.S. PATENT DOCUMENTS

| | | | |
|---|---|---|---|
| 4,227,968 | A | 10/1980 | Bodmann |
| 4,262,513 | A | 4/1981 | Pigott |
| 4,416,135 | A | 11/1983 | Russell |
| 4,633,699 | A | 1/1987 | Fuchs |
| 4,673,035 | A | 6/1987 | Gipson |
| 5,097,693 | A | 3/1992 | Kennedy |
| 5,105,642 | A | 4/1992 | Mohr |
| 5,335,527 | A | 8/1994 | Nagai et al. |
| 5,427,295 | A | 6/1995 | David |
| 5,660,067 | A | 8/1997 | Liao |
| 6,044,682 | A | 4/2000 | Cheng et al. |
| 6,557,742 | B1 | 5/2003 | Bobeczko et al. |
| 7,082,797 | B1 | 8/2006 | Wiese |
| 7,441,682 | B2 | 10/2008 | Kerekes et al. |

* cited by examiner

METHOD AND APPARATUS FOR APPLYING UNIAXIAL COMPRESSION STRESSES TO A MOVING WIRE

CROSS REFERENCE TO RELATED APPLICATIONS

This application is a continuation of U.S. patent application Ser. No. 12/830,897, filed Jul. 6, 2010.

BACKGROUND

In the prior art, there are numerous wire feed mechanisms but they operate at uniaxial compression stresses that are too low for the intended wire processing needs and push the wire with driven pinch rollers that contact the wire only over the very short span when the rollers meet. The available methods for producing high uniaxial compression stresses in the wire all apply multi-axial compression generally in the form of hydrostatic pressure, are high cost, have a single diameter feed stock and are usually used to extrude soft metals through large reductions.

Prior art wire feeding devices that are used to move wire with pinch rolls advance the wire with relatively low driving force capability. These devices are used in conjunction with devices that operate on the wire without requiring the use of high forces generated by the wire feed apparatus. Examples of low force wire feeding devices for general use are shown in U.S. Pat. Nos. 5,427,295, 6,557,742. U.S. Pat. No. 7,441,682 shows a device for feeding welding wire and the apparatus of U.S. Pat. No. 6,044,682 feeds wire to a set of wire shaping devices.

The manufacturing of coil springs by the deflection coiling using a pair of opposing drive rolls to grip and axially move the wire through a guide tube and against forming points to create a coil spring is shown in U.S. Pat. No. 7,082,797. All prior art devices use rigid, close clearance guide tubes to prevent the moving wire from unstable bending as it moves from the rolls to its destination. The wire is forced against tooling components that cause it to bend in the desired manner and in so doing create a resistance to the wire's motion that results in an axial compression stress in the wire. This prior art method is not capable of creating a sufficiently high axial compression stress states in the wire. First, the gripping action on the wire is provided by one or at most two pinch roller gripping stations.

For the most part, prior art that is in the field of continuous extrusion of wire fall into the categories of:

(a) mechanical extrusion in which the rod to be extruded moves along with a confining container as it is pushed into and through the stationary reduction die; or (b) hydrostatic extrusion in which the rod to be extruded is surrounded by high pressure fluid as it enters the reduction die.

Briefly, the continuous extrusion type processes are industrially known as:

1. Conform type continuous extrusion uses a circumferential groove in a rotating wheel to transport the rod into a zone in which the groove is covered by a stationary shoe that has an abutment that protrudes into the groove and blocks the rod from continuing to move along with the wheel groove and thus creates a pressure at the abutment which forces the rod to extrude through an orifice in the stationary shoe adjacent to the abutment. U.S. Pat. Nos. 3,765,216, 3,872,703, 4,227,968, 5,097,693, 5,335,527 and 4,094,175 are illustrative of this type of extrusion. The rod never leaves contact with the wheel groove before it enters the rod extrusion operation.

2. Linex type continuous extrusion might be considered a linear version of Conform type apparatus in that the gripping force on the feed stock is derived from the friction force applied by opposing gripping and moving, tractor tread like surfaces while the feedstock is being constrained on the other two sides as it is driven into an extrusion die. The feed stock is rectangular in cross section with the moving surfaces grip the wide face of feedstock and narrow faces lubricated. U.S. Pat. Nos. 3,922,898 and 4,262,513 are illustrative of this type of extrusion.

Friction drive continuous extrusion apparatus, that captures the feedstock bar in opposing roll grooves much like a rolling mill and drives the feedstock bar into a reduction die that is placed into the cavity formed by the mating roll groves and that blocks the exit of the rod or wire from leaving the moving grooves without passing through the die are illustrated in U.S. Pat. Nos. 3,934,446 and 4,220,029. Again the rod never leaves contact with the wheel groove before it enters the extrusion operation.

None of the above apparatus are suitable for extruding a wire form feedstock that is the continuous wire-to-wire extrusion application in which the wire must leave contact with the drive wheel before encountering the extrusion die.

The prior art on continuous hydrostatic extrusion of a wire product from a rod feed stock using some form of viscous fluid drag to develop a fluid pressure profile along the rod is in three forms:

a) Viscous drag consisting of a viscous fluid being circulated through a series of cavities that surround a central passage through which the rod to be extruded passes and such that the moving fluid acts on the rod in viscous shear manner to build up an axial compressive stress in the rod and force the rod through the die by hydrostatic extrusion as shown in U.S. Pat. No. 3,731,509.

b) Segmented Moving Chamber type using a pressure chamber that is constructed of multiple, wedge shaped extrusion chamber sections that move in a "tractor tread" manner with four "tractor tread" assemblies that bring the moving chamber segments together to form a continuously moving pressure chamber with a bore that transmits surface shear forces to the feedstock through a viscous medium and pushes it through a die in a form of hydrostatic extrusion as shown in U.S. Pat. No. 4,633,699.

c) Rotating grooved wheel and groove covering stationary shoe comprise the dominant components of this apparatus in which viscous fluid is injected under pressure along the enclosed passage to co-act with the rotating wheel groove and build the pressure in the viscous fluid as it approaches the extrusion die. The use of the moving wheel shearing of the viscous fluid builds the fluid pressure to cause hydrostatic extrusion as shown in U.S. Pat. No. 4,163,377.

None of the above apparatus are suitable for extruding a wire feedstock in a continuous wire-to-wire extrusion application.

Continuous, hydrostatic extrusion process for wire-to-wire reduction is given as shown in U.S. Pat. No. 3,841,129. In this apparatus, the wire is drawn into a high pressure chamber through a seal [which is represented as a wire drawing operation] by a capstan rotating within the large high pressure chamber. Then the wire leaves the capstan and goes to an extrusion die where it leaves the high pressure chamber by the process of hydrostatic extrusion. Also, patentee's proposed apparatus has numerous friction related energy losses between the moving parts and the moving parts in the high pressure viscous pressurizing medium that would substantially reduce the efficiency and durability of the apparatus.

SUMMARY

There is need for an apparatus with greater ability to continuously force a moving wire through various types of operations. These operations include altering the residual stress pattern in composite wires by pushing then through open die extrusion operations and uniaxially compression deforming shape memory alloy wires.

The method and apparatus of the present invention provide for continuously applying a high uniaxial compression stress to a moving wire. According to one aspect of the present invention, wires from 0.5 mm to over 5 mm in diameter can be uniaxially compressed up to at least one-half their axial compression yield strength and delivered to a device without allowing the wire to buckle. The apparatus comprises a forcefully rotated wire gripping and moving drive wheel where the wire is pressed into a peripheral "V" section groove in a relatively large diameter, rotated drive wheel using a set of small diameter, spring loaded rollers arranged along part of the periphery causing the wire to be gripped by the "V" groove. The multiplicity of small rollers with each pressure roller acting to clamp the wire into the drive wheel groove provides for a gradual buildup of the uniaxial compressive stress in the wire without damaging the wire. The number of pressure rollers is chosen to provide sufficient gripping locations such that the sum of their gripping capacities acts together to prevent the wire from slipping in the groove. The close spacing of the relatively small pressure rollers co-acting with the "V" groove wall supports the wire laterally to prevent it from buckling. The wire is ultimately separated from the drive wheel and delivered to a device that provides the high resistance to the wire's motion along its axis and uses the resultant high uniaxial compressive stress in the moving wire to perform a useful function. Examples of these device functions are open die extrusion of the wire and wire forming by forcing it against an abutment. The dimensions of the device hardware require that the traveling wire be moved far enough away from the drive wheel to enter the device.

For the purpose of transferring the highly compressed moving wire away from the drive wheel, a set of closely spaced; freely rotating small diameter rollers with grooves that are arranged with their axes along an arc to guide the wire's path are used. The arc has a radius typically about 20% larger than that of the drive wheel radius and the wire's path is tangent to the drive wheel at the location the wire is released from the "V" groove of the drive wheel. Thus the arc arrangement of these guide rollers causes the wire to be forced against the rollers by the uniaxial compressive stress in the wire which, in conjunction with the grooves in the rollers and their close spacing, prevents the wire from buckling. This arrangement allows the wire to move freely without diminishing the uniaxial compression stress in the wire or causing it to scrape on any surfaces that would be present if a fixed channel guide system were used. The use of rollers also prevents any buildup of foreign matter that could collect with a fixed surface guidance system.

The present invention is intended for many uses, but it is especially intended for the continuous extrusion of very long lengths of superconductor precursor composite wires. For this purpose, the wire cannot be damaged by deformation in the gripping—driving means that will have to move the wire against the extrusion reduction resistance that will cause axial compression stresses of from 30% to 50% of the compression yield strength of the wire.

DETAILED DESCRIPTION OF THE INVENTION

There are highly desirable wire processing needs that require an apparatus to axially push on wire to create a high uniaxial compression stress of up to at least 50% of its yield strength and to be able to continuously feed this highly stressed wire into certain special devices while preventing buckling. For convenience, the term "wire" will be used in place of the term "very long slender member" and includes rods and wires that may be round, shaped, hollow or composites. Devices according to the invention use the uniaxial compressive stress to perform open die wire extrusion and section shaping of composites, continuous hydrostatic extrusion of wire and large strain, uniaxial compression of shape memory alloys as well as other useful processing operations.

Uniaxial compression stress can be developed in a cylinder by applying opposing forces, which are aligned with its central axis, to ends of the cylinder pushing the ends toward each other. If the cylinder is very long compared to its diameter, such as a wire, then gripping the wire along its outside surface and pushing the gripped wire against some resistance to the wire's motion will also cause uniaxial compressions stress in the wire. If a series of multiple gripping locations for applying the force are used, then the uniaxial compression stress will increase along the length of the wire from the first grip location on to the last grip location. The multiple gripping method is the method used for developing uniaxial compression stress in a wire according to the method and apparatus of the present invention. Along the wire and beyond the gripping action there must be resistance to the wire's motion that opposes the pushing action of the gripping mechanism. One of the numerous choices to resist the motion of the wire can be an extrusion die that consists of a conical channel that leads to a channel exit opening having a diameter smaller than the wire diameter. Thus pushing the wire through the extrusion die reduces its diameter with this process of continuous extrusion and provides the opposing force resistance applied to the moving wire. This extrusion process is called open die extrusion since there are no lateral pressures on the wire at the die entrance as compared, for example, to hydrostatic extrusion in which highly pressurized fluid surrounds the wire at the die entrance.

Figure 1:
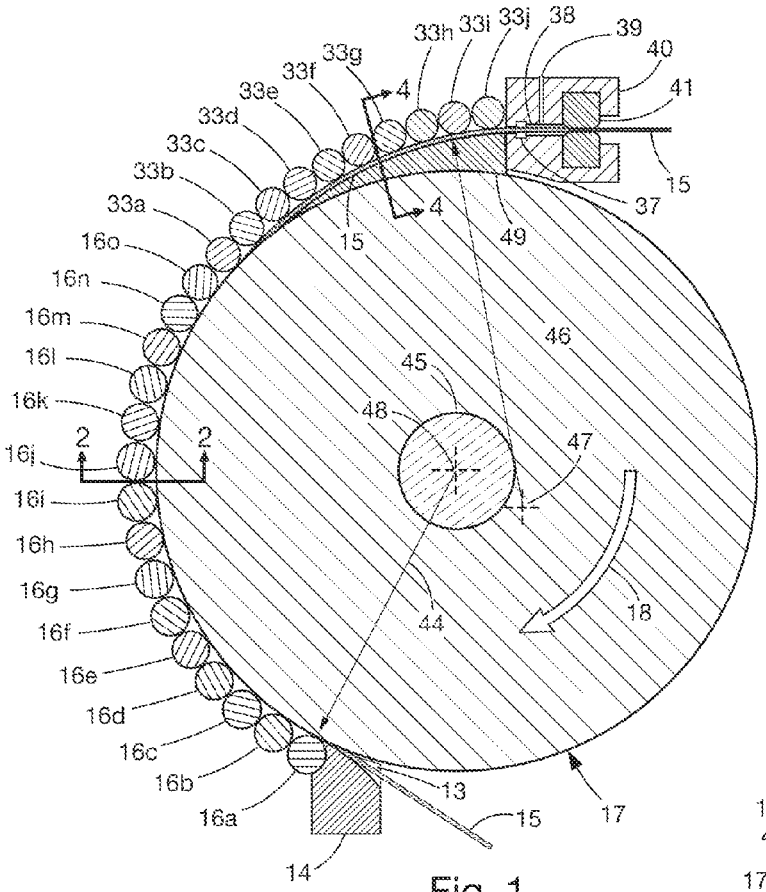
FIG. 1 is a cross-sectional view of an apparatus according to of the present invention.

The combination of multiple gripping locations acting on a moving wire to push it through an extrusion die can be effected by the apparatus shown in FIG. 1 and by the processes facilitated using the apparatus of FIG. 1

Referring to FIG. 1, a wire 15 is drawn into the apparatus by the action of pressure (or pinch) rollers 16*a*-16*o* pressing the wire into a "V" shaped groove in the peripheral surface of rotating wheel 17 having a radius indicated by arrow 44. Radius 44 is selected to be no smaller than the minimum allowable bend radius to avoid damaging the largest diameter of wire to be processed. Wheel 17 rotates on axle (shaft) 45, which is rigidly supported with a set of remotely located close tolerance ball bearings, and is driven in the direction indicated by arrow 18 with a torque sufficient to perform the function of the apparatus. In this description, the apparatus is configured as a open die continuous wire extrusion apparatus. Wire 15 is directed into the selected "V" groove in drive wheel 17 by a planar wire guide consisting of two identical plates 13 separated by a contoured shim 14 which is slightly thicker than the largest diameter wire 15 to be used in the selected "V" groove. The planar guide assembly can be fabricated from a hard, rigid, low friction, non-marring, wear resistant material such as acetal homopolymer. The planar wire guide opening must be positioned opposite to the "V" groove in service and the thickness of the contoured shim 14 must correspond to the wire 15 size range for the "V" groove. Furthermore, it is good practice to square cut the forward tip of wire 15, remove burrs and round the edges to aid in moving the wire 15 forward tip past each of the pressure rollers 16*a* through 16*o* during start-up.

Figure 2:
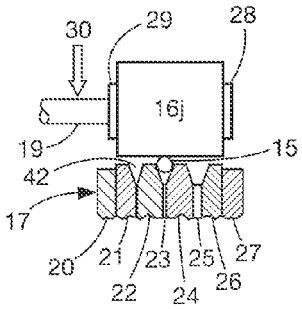
FIG. 2 is a view taken along line 2-2 of FIG. 1.

As wheel 17 rotates, the wire 15 continues to move within a drive wheel "V" groove created by discs 22, 24 as shown in FIG. 2, a sectional view of wheel 17, in which wire 15 is being pressed into the groove by roller 16*j*. Pressure roller 16*j* rotates freely supported on ball bearings 28 and 29 that are mounted on shaft 19 which is acted upon by a force that is applied by a remotely located force mechanism, such as described later in relation to FIG. 5, to push the roller 16*j* against the wire. In FIG. 1, there is a set of fifteen pressure rollers starting with roller 16*a*, continuing past roller 16*j* and ending at roller 16*o*. Each roller represents a wire gripping station. Depending on the groove geometry, wire diameter, wire material, coefficient of friction between the wire 15 and drive wheel 17, and force exerted on the wire 15 by the corresponding pressure roll, each gripping station has a capacity to hold the wire against the action of an axial force exerted on the wire without wire 15 slipping relative to drive wheel 17. The axial force exerted on the wire causes uniaxial compression stress within the wire. The total wire gripping capacity in terms of the maximum uniaxial compressive stress that can be generated within wire 15 is the sum of the axial force supporting capacities of all of the wire gripping stations. This total gripping capacity must be capable of generating an axial compressive stress that is equal to or exceed the stress required to perform a function in the final stage of an apparatus, a wire processing device that resists the axial motion of the wire. In this description the function of the final stage apparatus is wire diameter reduction by open die extrusion. Also, the pressure rollers 16*a* through 16*o* must have sufficiently small diameters to allow them to be spaced closely to each other to: (a) avoid compression buckling by unstable bending of wire 15 between pressure rollers and; (b) to allow the sufficient number of pressure rollers to be placed around a chosen portion the periphery of the drive wheel 17. For a larger wire diameter, the number of pressure rollers must increase to add the gripping capability needed to increase the forces on the wire to develop the desired uniaxial compression stress in the wire. This requirement arises from the increase in wire cross-sectional area as the diameter increases, which correspondingly reduces the uniaxial compression stress applied to the wire at each pressure roller gripping location without a matching increase in applied force (represented by arrow 30 in FIG. 2) to the pressure roller. For an approximation, the number of pressure rolls required equals the desired axial force to be applied to a wire to perform the final stage wire processing function divided by the maximum axial force, F, the holding capability of a single gripping location on the drive wheel. Force, F, can be estimated by dividing the force represented by arrow 30 in FIG. 2 of the pressure roll against the wire by the sine of the "V" groove wall angle $\alpha$ (FIG. 3), measured from the plane of the drive wheel, multiplied by an estimated coefficient of friction between the wire and "V" groove wall contact surface. A typical estimated coefficient of friction value is 0.15 and a conservative value would be 0.10. The configuration of the apparatus should allow for expanding the number of pressure rollers to achieve the desired performance if additional rolls are found to be required during operation. Furthermore, the wire and the "V" groove surfaces must be maintained free of any contamination from any substance that would reduce the friction between the wire and the "V" groove surfaces. The wire should be cleaned before entering the apparatus and the "V" groove can be periodically or continuously cleaned during operation with a brush and solvent such as acetone or alcohol.

Referring to FIG. 2, the drive wheel 17 is a lamination consisting of circular discs and shims 20 through 27 that are held together by the required number of fasteners to form a rigid drive wheel 17. Discs 21, 22, 24 and 26 have one or more beveled edges that co-act to form three peripheral "V" grooves, such as "V" groove 42. The geometry of the "V" groove can be changed by the insertion of shims 23 and 25. The purpose of multiple grooves is to be able to use a single drive wheel 17 for a larger range of wire diameters. The design of the multiple groove system is based on having the largest diameter wire that can be accepted into one groove being the smallest diameter wire that can be gripped in the next larger size "V" groove opening in the drive wheel.

Figure 3:
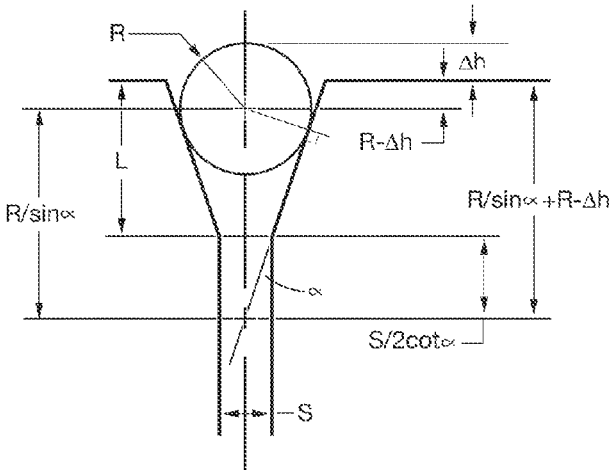
FIG. 3 is a schematic representation of the mathematical relationships for deriving the configuration of the grooves of drive wheels of the invention.

The design goal for a particular groove can be readily achieved using an equation derived with the groove geometry shown in FIG. 3. In FIG. 3, R=Wire radius; $\alpha$=Groove wall angle; L=Groove depth; S=Shim thickness; $\Delta h$=Wire protrusion out of groove. The equation relating the geometry variables is: $L=R/\sin\alpha+R-\Delta h-S/2\cot\alpha$. The criteria used in the equation for the largest wire that will be accepted by a groove is $R=\Delta h$. The smallest wire that can be accepted by the groove is the minimum practical $\Delta h$ and typically chosen as 0.005 inches.

Figure 4:
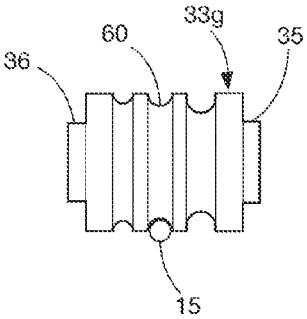
FIG. 4 is a view taken along line 4-4 of FIG. 1.

Referring to FIG. 1, after wire 15 leaves the influence of the last in the succession of pressure rollers, pressure roller 16*o*, the path of wire 15 becomes controlled by ten guide rollers starting with roller 33*a* and ending with roller 33*j*. As shown in FIG. 4, a typical wire guide groove 60, in the ten guide rollers is designed to match the wire 15 size ranges for each of the three "V" grooves in wheel 17. Guide roller 33*j* rotates freely on precision ball bearings 35 and 36 that are supported and positioned by a rigidly mounted shaft (not shown). The purpose of using freely rotating wire guide rollers instead of a stationary channel is to prevent friction drag on the wire that would diminish the uniaxial compression stress in the wire and cause wear of the wire. All of the guide rollers are of similar construction and their support shafts position them so as to guide the wire 15 along an arc with radius designated by arrow 46. Radius 46 is larger than the drive wheel radius 44 by an increment which is typically about 20% of the length of radius 44. When the tip of radius arrow 46 is placed on the drive wheel 17 periphery at the location of pressure roller 16*o*, the body of the arrow 46 must intersect the center of rotation 48 of the drive wheel 17 to define the location of center of curvature 47 for the wire path arc. This arc shaped path of wire 15 is defined by the position of the guide rollers, is tangent to the drive wheel 17 at pressure roller 16*o*. The arc path moves away from the drive wheel 17 to allow for sufficient clearance to place a wire processing device, e.g., an open die wire reduction extrusion assembly, in the path of the moving wire 15. The guide roller spacing coupled with the diameter of the wire 15 controls the maximum level of axial compression stress that can be applied to the wire 15 before it buckles in unstable bending. To maximize the allowable axial compression stress the roller spacing must be minimized which requires determining the minimum practical outside diameter of the guide roller. When determining the groove depth for the largest wire a guide roller can guide, the parameters are the support shaft diameter and material required for guide roller strength; the minimum outside diameter of the guide roller is generally around 6.5 times the diameter of the maximum size wire. Thus the roll spacing is about 7 times the diameter of the largest wire. Guide roller groove depths are about 75% of the largest wire diameter for a specific groove except for the first few rolls that will have shallower groove depths to match the wire arc path as it leaves the drive wheel 17 groove. The arc path of wire 15 is required to keep the wire pressed into the guide roller groove by the uniaxial compression stress in the wire. The number of guide rollers is determined by the length of arc path required to carry the wire to the wire processing device which must be some distance away from the drive wheel due to its size. Also, wire 15 is shown leaving contact with guide roller 33*j* in a horizontal orientation; however, the orientation of the direction of the wire moving away from the apparatus can be chosen in other orientations for convenience by rotating the whole apparatus. The approach angle of the wire to the apparatus will depend on the wire exit orientation, the number of pressure rollers and the geometry of the wire exit guidance system that, in combination, dictate the relationship of the angle between the wire's approach and the wire's exit paths.

In FIG. 1, immediately following the last guide roll 33*j*, the wire 15 enters a wire inlet guide 37 that has an opening with a close clearance fit to the wire. The wire passes through inlet guide 37 into a short lubrication chamber 38 which receives lubricant through opening 39 in die block 40 which contains and supports extrusion die 41. The position of the die block 40 must be adjusted so the die block assembly, inlet guide 37 and die 41, are in alignment with the guide roller 33*j* groove and the proper "V" groove in drive wheel 17. Also, as shown in FIG. 1, a wire support wedge 49 is used briefly during two operations. This support wedge 49 has the width of the guide rollers 33*a* through 33*j* with its upper surface near but not touching the guide rollers and its lower surface near but not touching the drive wheel 17. When the wire 15 is initially fed into the apparatus, the support wedge 49 constrains the wire to stay in the grooves of the guide rollers so the wire is aligned to pass through inlet guide 37. Again later, the support wedge co-acts with the guide rollers to control the path of the trailing end of wire 15 through the guide roller section of the apparatus once it is no longer being pushed by the drive wheel but is being pulled out of the apparatus by some remote means.

Figure 5:
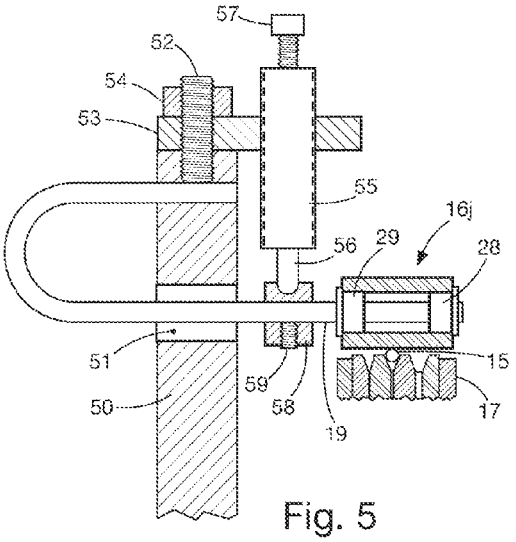
FIG. 5 is a fragmentary view partially in section showing a pressure roller assembly according to the invention.

FIG. 5 illustrates the means for supporting the pressure roller 16*j* and applying an adjustable force 30 to shaft 19. The freely rotating pressure roller 16*j* consists of a hollow cylinder of rigid material with a bore that accepts the outside diameters of flanged precision ball bearings 28 and 29 that are mounted on shaft 19. Shaft 19 passes through a slot 51 in mounting plate 50 and then curves back to fit into aperture 60 in mounting plate 50. The configuration of shaft 19 allows it to be flexed with low force resistance to movement in the plane of the drawing. The shaft 19 is clamped in position by set-screw 52. A support bracket 53 is attached to the mounting plate 50 using the protruding section of set-screw 52 and nut 54. This mounting bracket 53 has a threaded aperture which holds the threaded body of a round-nose spring plunger 55 such that the movable plunger tip 56 of spring plunger 55 fits into a socket in shaft collar 58. Shaft collar 58 is held to shaft 19 by set screw 59. The end of the adjustment screw 57 contacts the end of the spring inside the spring plunger body. Screw 57 can be turned to various positions to compress the internal spring and adjust the force that the plunger tip 56 exerts on the collar 58 and therefore the shaft 19 and in turn adjusts the force of pressure roller 16*j* on wire 15. This pressure roll force adjustment allows the apparatus to be used on a wide range of wire strengths and diameters. For use in an apparatus that processes wire diameters from 0.030 to 0.057 inches, a spring plunger with a capacity of 3 to 15 pounds force was chosen.

The materials, tolerances and surface finishes of the path for the majority of the components can be readily determined by one familiar with machine design practice. According to the invention, the discs 21, 22, 24 and 26 with beveled edges used to construct drive wheel 17 will be subjected to high stresses and surface wear so they must be constructed with materials that have yield strengths above 80,000 psi and be wear resistant. High carbon Alloy 1075 cold rolled steel sheet may be used, but for greater wear resistance, a material such as hardened 400 series stainless steel will be a good choice. The beveled surfaces that contact the wires should have a 32 or less RMS surface roughness. The pressure rollers 16*a* through 16*o* may be fabricated from hard bronze Alloy 954 sleeve bearings so they won't be indented by the wire 15 unless the wire 15 is high strength and the roll pressure is increases in which case tool steel should be used. Component alignment should be such that it maintains the intended wire path position within +/−3% of the largest wire diameter and/or +/−5% of the smallest wire diameter. This design guide is intended for use in specifying component tolerances and clearances as well as component and assembly rigidity that will influence relative component movement under loaded conditions.

A wire 15, being uniaxially compressed within a "V" groove of the drive wheel 17, must slip as it shortens elastically under increasing uniaxial compression stress. Typically, a wire will shorten by on the order of 1/10 percent in length between the first and last pressure roller and therefore must leave the drive wheel groove moving very slightly slower than the entering speed by that shortening percentage. This strain is calculated from the compression stress generated in the wire and the elastic modulus of the wire material. The long term effect may be some very slow wearing of the wire contact surfaces of the drive wheel's "V" groove surfaces. The immediate effect may be to generate very fine wear particles pulled from the wire's surface. They may be removed from the wire in the guide roller zone and/or from the wheel groove with a stream of non-lubricating fluid (liquid or gas) to prevent them from being carried on the wire into the extrusion die entrance. However, if they are carried past the wire inlet guide 37 (FIG. 1) into the lubrication zone and die entrance, then they must be managed by the lubricant to prevent interfering with the lubrication in the die. Even if the lubricant is an excellent, high pressure boundary lubricant, it may be prevented from performing well if the metal particles accumulate at the die entrance and block lubricant flow into the deformation zone. The particles tend to be too large to enter into the deformation zone with the fluid lubricant film. For successful lubrication, the particles must be trapped in a layer of lubricant that is carried on the wire toward the die extrusion entrance. That layer is stripped off at the die entrance leaving only a only a very thin film of lubricant remaining bonded to the wire that enters the die deformation zone. The excess lubricant layer changes its flow direction and follows the contour of the die face moving away from the wire carrying off the entrained particles.

Figure 6:
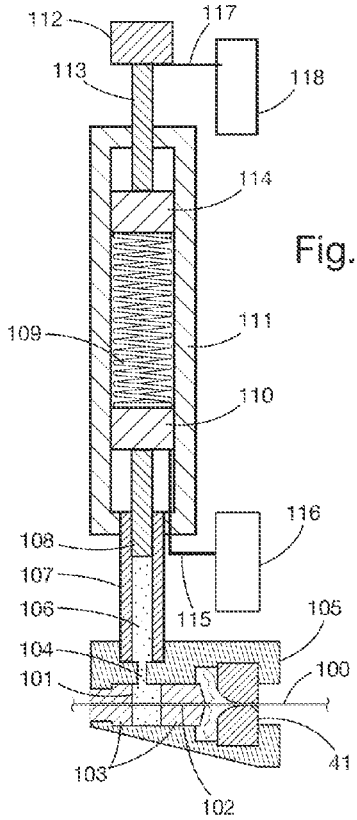
FIG. 6 is a cross-sectional view of a lubrication device according to the present invention.

One successful lubricant system that was tested consisted of beeswax forced into the lubrication cavity with a spring actuated ram as shown in FIG. 6. Referring to FIG. 6, a wire 100, which is moving (left to right as shown in FIG. 6.) during extrusion, receives a lubricant layer by passing it through a cavity 101 filled with pressurized beeswax which deposited a layer of beeswax on the surface of the wire before it enters horizontal passage 102. The cavity 101 is formed by a cross-bore in the wire guide 103 which has a horizontal passage 102 that is 0.002 inches to 0.005 inches larger than the wire 100. The beeswax enters the cavity through passage 104 in the die holder 105. The beeswax in chamber 106 (formed by the interior of a 1/8 inch NPT schedule 8 pipe nipple 107 that is 3" long) is pressurized by a 0.208" diameter ram 108. Ram 108 is acted on by a compression spring 109 with a 3/4" outside diameter, 3" length and a 115 pounds per inch spring constant. The force of spring 109 is transmitted to ram 108 through the lower bearing block 110 contained in housing 111 that is attached to pipe nipple 107 with threads. Prior to inserting the wire through guide 103, the beeswax is pressurized in chamber 106 by turning knob 112 which is attached to threaded shaft 113 that pushes on the movable upper bearing block 114. As the beeswax is forced into cavity 101, the block 110 and ram 108 move downward as indicated by the gauge rod 115 reading on scale 116. The displacement reading from scale 116 is subtracted from the displacement reading of the position of knob indicator 117 on scale 118 to give the compression of the spring 109. Therefore, the spring force determined using the spring constant is used to calculate the pressure exerted by ram 108 on the beeswax column 106. It was observed that a spring force of 41 pounds force which produced a ram pressure of about 1300 psi was more than sufficient to fill the cavity 101 through a 3/32 inch diameter passage 104 and keep it full during extrusion. Then wire 100 is pushed through guide 103 and the beeswax in cavity 101 before being extruded through die 41.

Figure 7:
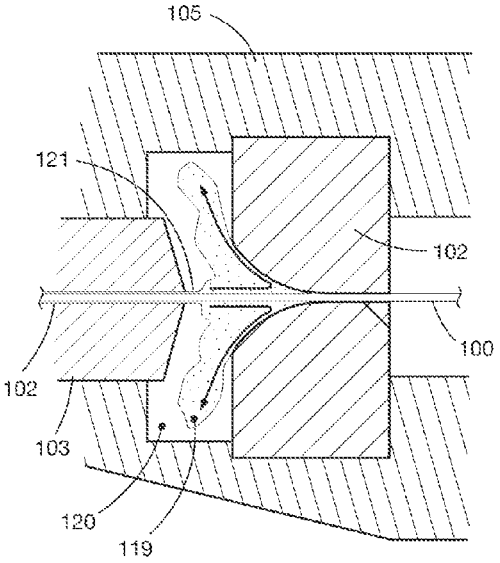
FIG. 7 is an enlarged fragmentary cross-sectional of the lubrication device of the present invention.

Referring to FIG. 7, a layer of beeswax 121 is picked up on the surface of the moving wire 100 in cavity 101 (FIG. 6) and is carried along with the wire until it reaches the extrusion die 41 entrance where a very thin film of the beeswax remains on the wire as it enters the extrusion deformation zone and the remainder of the beeswax layer changes flow direction and moves outward along the die face (as indicated by the arrows) and forms a flash 119 of excess beeswax. Any contaminating particles on the surface of the wire are trapped in this excess beeswax layer and are removed from the process. The excess beeswax flash may exit through openings in the die holder as it grows and can be removed as desired. The foregoing beeswax lubrication mechanism was given by way of example and one skilled in the art of design may design other successful lubrication mechanisms.

The use of continuous wire uniaxial compression for open die extrusion is beneficial for certain very important composite wire products. These products are superconductor wires with current flow stabilizing outer layers made of copper that cover the inner cores of multiple superconductor sub-elements or filaments such as shown in U.S. Pat. No. 5,534,219 and in FIG. 5 on page 180 of reference *Composite Superconductors* edited by Osamura, both references incorporated herein by reference. Typically, the outer stabilizing layer is relatively low strength high purity copper and the core sub-elements are higher strength complex composites consisting substantially of niobium with some copper and tin. During the superconductor wire fabrication process, relatively large diameter composite bars are drawn on draw benches and then after reaching several millimeters in diameter, they are reduced to under 1 mm in diameter by wire drawing. During the wire drawing process, an adverse residual stress pattern develops and builds in intensity with axial compressive stress in the outer softer copper layer and a balancing axial tensile stress in the composite core. Drawing these hard core composite wires through the reduction dies cause the adverse residual stress pattern. This residual stress pattern is adverse because it creates a high shear stress at the interface between the copper layer and core that leads to cracks in the outer layer of the core and breakage during wire drawing. This problem becomes worse as the number of sub-elements that make up the core increases and their diameters decrease which concentrates the interface shear stress effect on smaller sub-elements. However, superconductor properties increase with more numerous, smaller core sub-elements so this problem currently tends to limit the development of higher performance superconductors with this structure. When the uniaxial compression stress imposed on the wire by using this invention for open die extrusion wire reduction instead of the wire drawing process, the uniaxial compression stress counteracts the adverse residual stress. It does so by axially compressing the outer, lower strength layer of copper to relive the tensile stress in the core sub-elements and drastically reduce or eliminate the damaging shear stress at the core to shell interface. The use of this invention is anticipated to play a major role in the advancement of superconductor performance improvement.

Figure 8A:
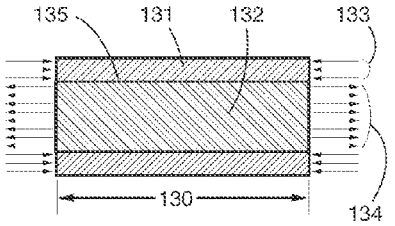
FIG. 8*a* is a schematic representation of a residual stress pattern detail of a short segment of composite wire.
Figure 8B:
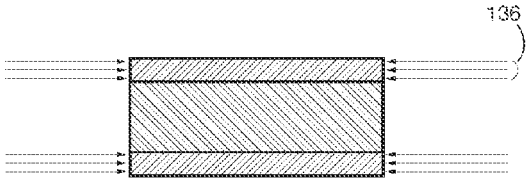
FIG. 8*b* is a schematic representation of superimposing uniaxial compression stress on a short segment of composite wire.

FIG. 8*a* is a schematic representation of a longitudinal cross section of a short length of composite wire about 2.5 diameters long showing the internal residual stress pattern in the wire. A short length of composite wire 130 with an outer copper layer 131 and complex core of sub-elements 132 with a simplified internal residual stress pattern represented by arrows with compression stress shown by a typical arrow set 133 and tensile stress shown by a typical arrow set 134. This stress pattern causes a very high shear stress concentrated at the interface between the core and outer layer 135. In an example using the typical geometry with the composite wire core and outer layer cross sections equal and the residual stress levels for 133 and 134 of 30,000 psi in magnitude, the influence of superimposing a 15,000 psi uniaxial compression stress over the full transverse cross section of the wire was calculated. The elastic modulus values are very similar for the core and outer layer. For this special case, the results are shown schematically in FIG. 8*b* with the stress in the core going to zero and the axial compression stress 136 in the outer layer becoming 60,000 psi. This new stress pattern is highly desirable because the damaging interface shear stress has dropped to zero. Actually, for the open die wire extrusion of a typical copper layer, niobium-tin core superconductor composite through a 5% area reduction, the superimposed uniaxial compression stress will be about 15,000 psi so open die extrusion will be very effective in reducing the adverse residual stress pattern in the wire during extrusion.

Figure 9:
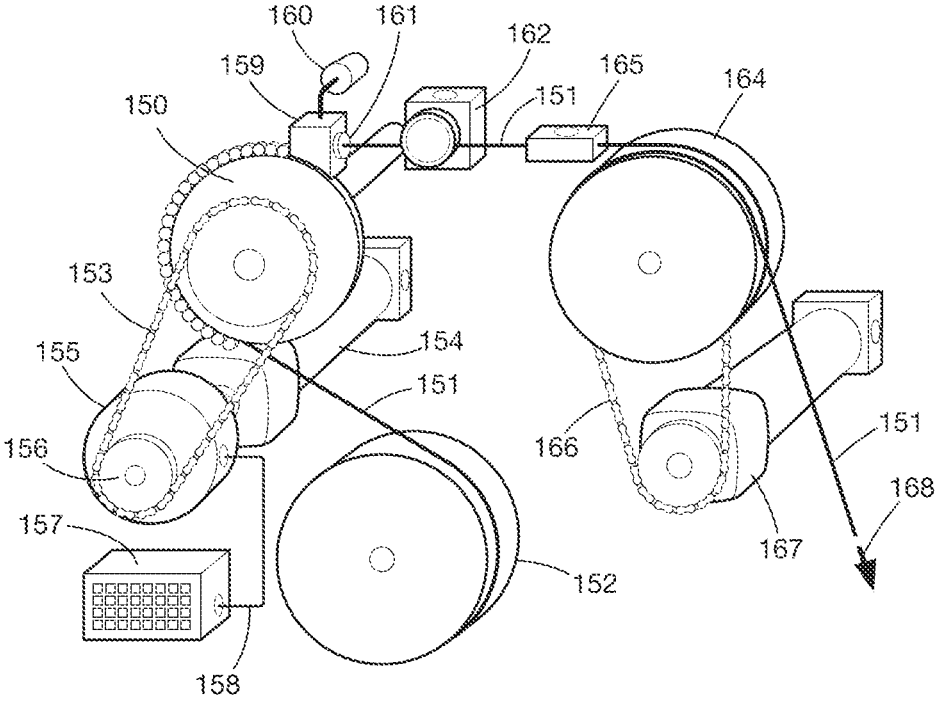
FIG. 9 is a schematic representation of a continuous wire extrusion system according to the invention.

Referring to FIG. 9, a schematic representation of a wire extrusion system shows the significant components, not necessarily shown in the exact relative positions they would have in an actual manufacturing set-up. FIG. 9 illustrates how the use of wire drive wheel assembly 150, made up of parts 16*a* through 33*j* plus 13, 14, 45 and 49 shown in FIG. 1, might be implemented to create an open die wire extrusion system. The mounting plates, frames, shafts, bearings and the like are not shown. The wire 151 to be extruded is unwound from spool 152 and enters the "V" groove of the drive wheel in assembly 150 at the first pressure roller (see FIG. 1) and is moved as the drive wheel is turned by the action of drive chain 153. The mechanical drive power for drive chain 153 comes from the remotely controlled variable speed gear motor 154 that acts through magnetic particle clutch 155 to turn the drive sprocket 156. The driving torque applied to sprocket 156 is controlled by the magnetic particle clutch 155 that receives its torque control electrical current from a remotely controlled power supply 157 through wire 158. Thus, the wire drive wheel assembly 150 is being rotated at controlled speed and torque with remote control and is creating the uniaxial compression stress necessary to continuously move and push the wire 151 against and through an extrusion die (not shown) inside die holder and lubricator assembly 159. Assembly 159 serves the same function as the components shown in FIG. 6 and the wire extrusion proceeds in the same manner as previously described in relation to FIG. 6 and FIG. 7. The force of the wire on the extrusion die is measured by a washer type force sensing load cell 161 located so that it supports the force from the wire pushing on the extrusion die. Also shown is a rotation signal encoder 162 that is turned by the rotating shaft of the drive wheel and is used to determine the speed of the moving wire before extrusion. The extruded wire 151 is pulled by capstan 164 and the tension in the wire is measured by a commercial device 165 or some other means such as a load cell in the capstan support system.

Typically, the wire extrusion system of FIG. 9 is operated by setting the predetermined speed of gear motor 154 and using magnetic particle clutch 155 to raise the uniaxial compression stress in the wire 151 to about 80 to 90 percent of the compression stress required to extrude the wire as measured with load cell 161. Next, the lubrication system 160 is activated and the capstan 164 rotated by variable speed gear motor 167 using chain drive 166. The wire moving speed of capstan 164 is set below the wire drive wheel wire moving speed that is controlled by the speed setting of gear motor 154. The rotating capstan 164 applies a tension to wire 163 that provides the additional axial stress in the wire required get the wire flowing through the extrusion die. The extruded wire 151 will have up to a few turns around the capstan 164 and the wire 151 leaving the capstan will be under a low tension that is applied to it by a remote wire winding apparatus common to the wire fabrication industry. The low tension in wire 151 exiting the system of FIG. 9 is required to keep it tightly wound on the capstan 164 to maintain the friction between the wire and capstan for a proper pulling operation. The data acquisition and display hardware along with the control system has not been described because those elements are common art. FIG. 9 and the associated description illustrate an approach to how the operation of apparatus of this invention may be integrated in a unique manner with readily available industrial components to create a system that uses its unique and valuable capabilities.

Figure 10:
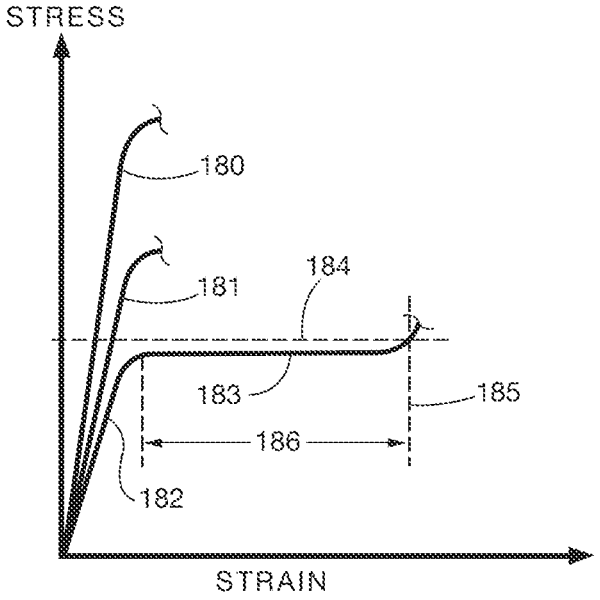
FIG. 10 is a plot of stress against strain behavior common to shape memory alloys.

The next application of this invention will be to uniaxially compress a shape memory alloy (SMA), such as those in the Ni—Ti alloy system, while in the low strength martensite crystalline structure state so it can exhibit strain recovery and elongate when heated to above the austenite transformation temperature in a final use application. The mechanical behavior and terminology relating to shape memory alloy is well represented in the literature. One reference, incorporated by reference herein, is "The Fatigue Behavior of Shape-Memory Alloys" by K. E. Wilkes and Peter K. Liaw containing definitions of the terminology used in this description. FIG. 10 shows a general plot of the stress-strain behavior common to shape memory alloys. The linear elastic stress-strain behavior of the basic three crystalline structure states are shown as plot 180 for the austenite, plot 181 for pseudo-elastic and plot 182 for martensite. In addition, the plastic strain plateau stress for martensite crystal structure is shown as line 183 in FIG. 10.

Figure 11:
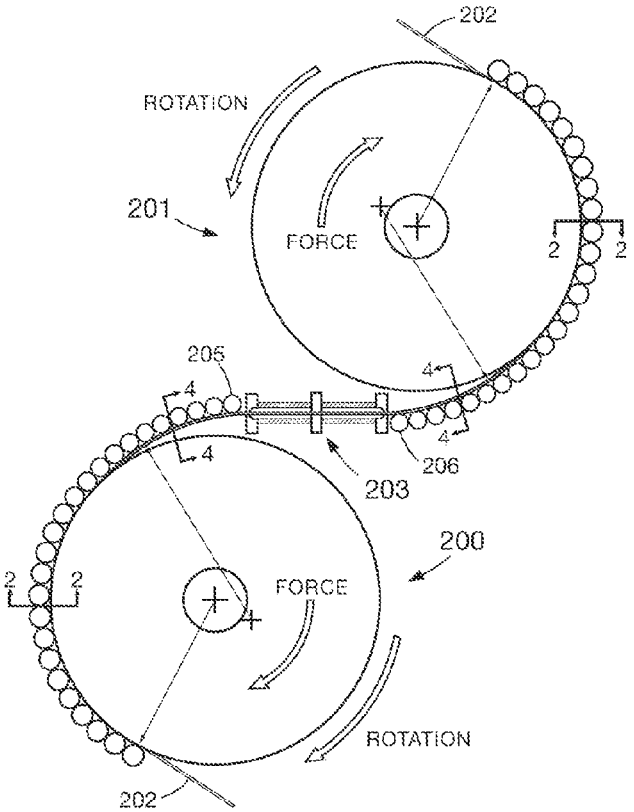
FIG. 11 is a schematic representation of two drive wheel and guide roller assemblies cooperating to uniaxially compress wire.

In the application to be described, the shape memory alloy wire 202 is first uniaxially compressed in a drive wheel assembly 200 shown in FIG. 11 to a stress level shown by line 184 in FIG. 10 with the wire in the austenite or pseudo-elastic state with a temperature above martensite start temperature, Ms. Next, the axially, elastically compressed wire enters a close clearance channel device 203 where it is chilled to a temperature of Mf causing wire 202 to transform to martensite. The yield strength of the martensite phase is below the stress level 184 so the wire is plastically compressed to a total axial strain value indicated by line 185 in FIG. 10. The total plastic strain is indicated by the strain dimension arrow 186. As wire 202 continues to move through device 203, it passes through a heating zone where its temperature is raised above the martensite start temperature, Ms, but not above the austenite start temperature, As, and transforms to the stronger, pseudo-elastic phase. The wire then exits from device 203 into the guide roller section of the drive wheel assembly 201. Drive wheel assembly 201 applies force to the wire 202 that resists the motion of the wire and acts against the force applied to the wire 202 by drive wheel assembly 200 to create the uniaxial compression stress level 184 shown in FIG. 10. The high uniaxial compression stress in wire 202 is relaxed as the wire progresses through the gripping stations on drive wheel 201 and leaves the drive wheel assembly 201 in an essentially stress free condition.

Figure 12:
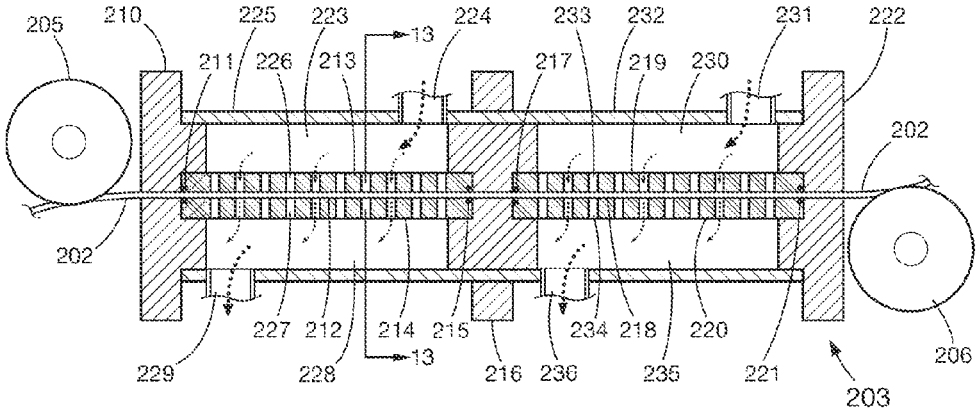
FIG. 12 is an enlarged longitudinal cross-sectional view of the apparatus interposed between the two drive wheel assemblies in FIG. 11.

Referring to FIG. 11, two apparatus assemblies of this invention can be used with one assembly 200 pushing the wire 202 through device 203, which is detailed in FIG. 12, and into apparatus assembly 201 that counteracts the force on the wire it receives from the drive wheel assembly 200. This action causes the wire to be subjected to a high uniaxial compression stress while inside device 203. When the wire leaves guide roller 205, it will enter device 203 and when the wire leaves device 203, it will inter the groove in guide roller 206.

To avoid buckling wire 202 within drive wheel assembly 200, the uniaxial compression stress generated by the drive wheel assemble 200 must be under about two-thirds the compression yield strength of the wire. However, this same uniaxial compression stress in the wire must be at least slightly above the yield strength and stress plateau 184 of the wire in its martensite state needed to achieve uniaxial compression plastic deformation. Therefore, wire 202 must be in the austenite or pseudo elastic states so that its yield strength will be at least 1.5 times the martensite state yield strength. These conditions are achieved by controlling the temperature of the wire in the manner previously described above.

Figure 13:
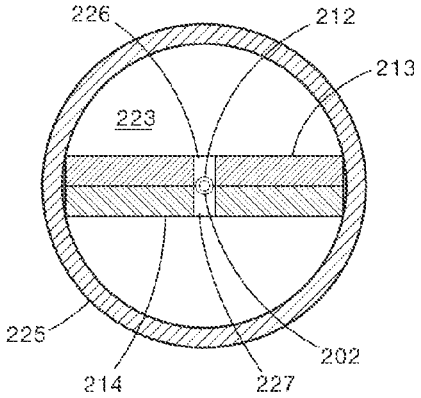
FIG. 13 is a view taken along line 13-13 of FIG. 12.

Referring now to FIG. 12, wire 202 passes from guide roll 205 into the passage in entrance cap 210 of assembly 203. The wire 202 then travels through fluid seal 211 into a close clearance channel 212 which is the wire cooling and compression chamber comprised of upper plate 213 and lower plate 214, shown in additional detail in FIG. 13. Leaving the channel 212, the wire has been axially compressed in channel 212 before it passes through fluid seal 215, center platen 216 and fluid seal 217 into close clearance channel 218. The wire is heated to a temperature above the martensite phase start temperature, Ms, in channel 218 which is formed between upper plate 219 and lower plate 220. Wire 202 passes from channel 218 through fluid seal 221 and a passage in exit end cap 222 and then into the groove in guide roller 206.

The wire 202 is cooled to below the shape change alloy's martensite finish temperature, Mf, by fluid coolant flowing across the wire as it passes through channel 212. As the wire structure converts to the martensite phase, its yield strength drops and the high uniaxial compression stress causes it to yield and be axially compressed with a large strain of up to 7% in magnitude. The channel inside diameter is larger than the wire diameter by not less than 10% of the wire 202 diameter and not more than 20% of the wire 202 diameter and it provides the lateral support required for preventing the wire from buckling. The coolant fluid 223, which may be alcohol for example, enters through coolant inlet port 224 in coolant containment housing 225 and is distributed across upper plate 213 before it passes through one of the many passages, such as a typical passage 226, and across wire 202. The coolant continues to flow around wire 202 and then through an opposing passage, such as a typical passage 227, in lower plate 214. The coolant will collect in cavity 228 below lower plate 214 and then flow out of coolant outlet 229 and on to the remotely located coolant chiller, reservoir, circulation pump and filter. The coolant circulation rate will depend on the geometric parameters of the system, wire 202 diameter, typically between 0.02 and 0.06 inches, and entrance temperature, coolant fluid temperature and wire speed, but it is anticipated that the pump pressure will be under 10 psi and rate under 90 gallons per hour.

After being uniaxially compressed, the wire 202 leaves the cooling and compression channel 212 to pass through fluid seal 215, center platen 216, seal 217 and into a close clearance warming channel 218. Channel 218 is the wire warming chamber comprised of upper plate 219 and lower plate 220 and has a construction similar to that shown in additional detail in FIG. 12. The wire 202 is heated to above the shape change alloy's martensite finish temperature, Mf, by a warming fluid flowing across the wire as it passes through channel 218. As the wire structure converts to the pseudo elastic phase, its yield strength increases and the high uniaxial compression stress in the wire 202 is not greater than two-thirds the heated wire's yield strength by the time the wire 202 reaches fluid seal 221. The channel inside diameter is larger than the wire diameter by not less than 5% of the wire 202 diameter and not more than 20% of the wire 202 diameter and it provides the lateral support required for preventing the wire from buckling. The non-lubricating warming fluid 230, which may be alcohol for example, enters through coolant inlet port 231 in coolant containment housing 232 and is distributed across upper plate 219 before it passes through one of the multiple passages, such as a typical passage 233, and across wire 202. The warming fluid continues to flow around wire 202 and then through an opposing passage, such as a typical passage 234, in lower plate 220. The warming fluid will collect in cavity 235 below lower plate 220 and then flow out of outlet 236 and on to the remotely located fluid heater, reservoir and circulation pump. The warming fluid circulation rate will depend on the geometric parameters of the system, wire 202 diameter and entrance temperature, warming fluid temperature and wire speed, but it is anticipated that the pump pressure will be under 10 psi and rate under 60 gallons per hour.

Figure 14:
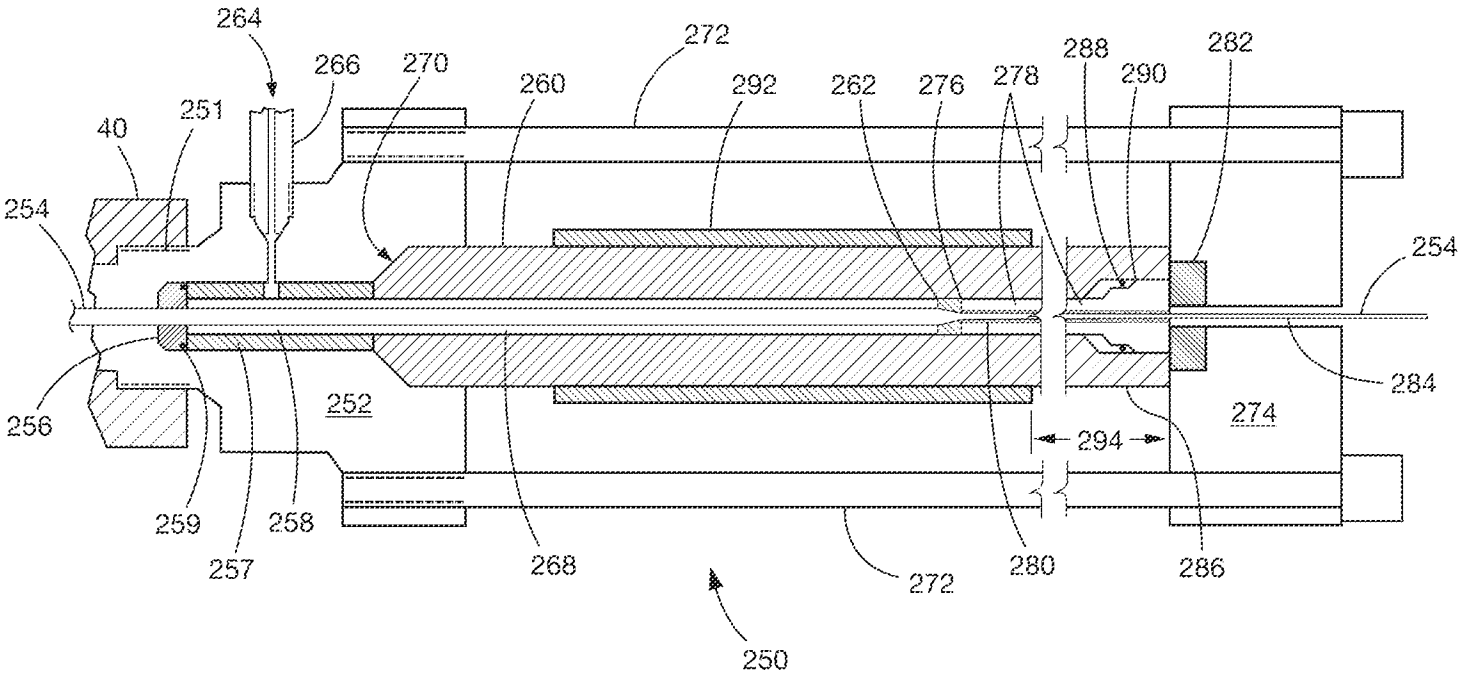
FIG. 14 is a cross-sectional view partially in section of a high pressure container assembly of the present invention for continuous hydrostatic wire extrusion processing.

The continuous open die extrusion apparatus depicted in FIG. 1 can be readily converted to perform continuous hydrostatic extrusion by attaching the high pressure container assembly 250 shown in FIG. 14. The die holder 40 in FIG. 1 is modified with a screw thread added to the inside of the cavity which held die 41 so forward container 252 can be screwed into it. Wire 254 is pushed by the drive wheel through the lubrication zone inside die holder 40 and into container 252 where it first encounters seal die 256 that has a very light interference fit to the wire and is held in place by retainer 257. The wire 252 continues to move through the channel 258 in container 252 and into pressure chamber 260 where it contacts extrusion die 262. Wire 252 is extruded through die 262 by the high uniaxial compression stress in the wire 252 which is supported from buckling in the span between die seal 256 and extrusion die 262 by pressurized fluid with a hydrostatic pressure that is maintained at a value 5% to 10% under the uniaxial compression stress in the wire.

The pressurized fluid 264 enters through conduit 266 to pressurize the cavity 258 the bore 268 of pressure chamber 260. The fluid 264 is prevented from leaking past the outside of seal die 256 by elastomer O-ring seal 259. The fluid is prevented from escaping at the conical interface of forward container 252 and chamber 260 due to a two degree mismatch between the semi-cone angles of the mating surfaces which causes a the highest contact pressure at location 270. Chamber 260 is forced against forward container 252 by tightening multiple strain rod bolts 272 that act on platen 274 that in turn acts on chamber 260. There is a relatively soft metal washer gasket 276 between extrusion die 262 and die support 278 which prevent fluid from leaking into the bore 280 of die support 278. Die support 278 contacts bearing block 282 that fits into a cavity in platen 274 and both bearing block 282 and platen 274 have a continuous passage way 284 through which extruded wire 254 exits from assembly 250. A portion of the internal bore of chamber 260 is increased in diameter to form a larger diameter cavity 286 to accommodate the larger diameter portion of die support 278 which is contoured to accept elastomer seal O-ring 288 and anti-extrusion miter ring 290 that prevent high pressure fluid from leaking out of chamber cavity 286.

The apparatus 250 is capable of performing continuous hydrostatic extrusion at ambient temperature. For heated continuous hydrostatic extrusion of wire, a chamber heater 292 will need to be added to create a heated zone in pressure chamber 260 that will be similar in length and location of the chamber heater 292. This design approach is used to create temperature gradients in the non-heated sections of chamber 260 that will allow the outer ends of apparatus 250, namely the forward container 252 and platen 274 regions to remain much cooler for convenience of operation and for the use of elastomer O-ring seals 259 and 288. The unheated length of pressure chamber 294 can be varied depending on the temperature of the heated zone of chamber 260 in contact with chamber heater 292. Choosing the length of the heated zone is a tradeoff between greater allowable speed of wire 254 and apparatus cost. Operating temperatures of up to 1000° F. and pressures as high as 150,000 psi may be possible right choice of component and fluid materials. For the highly stressed, high temperature components, C-350 grade maraging steel is a good choice. However, it should be noted that the limit on highest operating pressure, which is imposed by the drive wheel assembly (FIG. 1) performance, for a given wire 254 will be about ⅔ the ambient yield strength of that wire. High temperature silicone fluid may be used for pressurization. O-ring seals of Viton will survive a single pressurization at temperatures above their 450° F. rating. The seal die 256 should be made of a very hard, wear resistant material such as tungsten carbide. A good choice for the extrusion die 262 is C-350 maraging steel or H-13 tool steel.

In one commercial application, continuous, high temperature hydrostatic extrusion is used for reducing wire with limited ductility that requires the high temperature and pressure environment to allow forming the material without cracking it. Another application will be for taking very large reductions on work hardened wire that becomes much softened by an order of magnitude upon heating. Also, by exchanging the chamber heater 292 for a cooling jacket, the assembly 250 will be able to perform low temperature hydrostatic extrusion that would be useful for shape memory alloy wire extrusion. For this application, the wire 252 could be pushed into the apparatus in the austenite or pseudo-elastic condition, cooled below the martensite finish temperature, Mf, to convert the wire to the lower strength martensite structure and then reduced in diameter by extrusion.

The apparatus described as assembly 250 can have many variations. For example, die 262 can be reconfigured to have a direct metal-to-metal seal directly with the platen end of pressure chamber 260 so if platen 274 is also heated, the heated zone defined by the length of chamber heater 292 can extend to platen 274.

The following examples represent use of the processes and apparatus of the present invention.

Example 1 represents a wire extrusion application that was configured in a manner similar to that shown in FIG. 9 but with several differences. The encoder 162 was not used. Also, instead of using a wire tension measuring device 165, the structural frame for mounting the capstan 164 and gear motor 167 was supported on a shaft with bearings that allowed it to pivot in the plane of the capstan. An arm from this pivoting structural frame rested on a force measuring load cell such that the tension in wire 163 could be determined. Another variation from the arrangement shown in FIG. 9 was that the end of wire 163 was attached to a short cable that was in turn attached to capstan 164.

The apparatus was constructed for the purpose of extruding wire with diameters ranging from 0.030 inches diameter to 0.057 inches in diameter. The 8 inches diameter drive wheel 17 had three "V" grooves designed in accordance with the procedure given in the Detailed Description. A total of fifteen, 0.375 inch diameter pressure rollers spaced on 0.40 inch centers were used and the force each roller could exert on the wire was adjustable from 3 to 15 pounds. The ten, 0.375 inch diameter guide rollers each had three wire guiding grooves. Their centers were spaced 0.4 inches apart and they arranged on an arc of 5 inch radius. After leaving the last guide roller that is immediately adjacent to the die holder that is similar to part 105 shown in FIG. 6, the wire enters the wire guide 103. The die holder was modified with an extended one inch diameter cavity that accepted in sequence—a standard one inch outside diameter wire drawing die followed by a steel spacer washer and a one inch outside diameter by 0.20 inch inside diameter washer type, 200 pound capacity force load cell. A support plate, with a passage channel for the extruded wire, was attached to the die holder with threaded fasteners to hold the load cell and die in place against the forces on the die.

The apparatus was completely assembled with the lubrication device shown in FIG. 6 filled with beeswax lubricant. The spring force 30 in FIG. 2 on each pressure roller was adjusted to about 4 pounds force for the extrusion of unalloyed copper wire. Referring to FIG. 6, the initial step was to pressurize the beeswax lubricant to cause it to fill the cavity 101 within the entrance guide 103. Next, referring to FIG. 1, the forward tip of the wire 15 to be extruded was pushed under the first pressure roller **16*a* in the drive wheel groove selected based on the wire's diameter. The drive wheel 17 was rotated with a low torque setting until the wire tip moved through the beeswax and contacted the entrance of the extrusion die 41 which resulted in a force reading on load cell 161 In FIG. 9. Data acquisition was initiated to record the extrusion parameters. Continuing to refer to FIG. 9, the torque on the drive wheel was increased by raising the voltage on the power to the magnetic particle clutch 155 until only a short length of wire was extruded before the drive wheel torque was decreased to stop the extrusion. Using a miniature clamp, the wire was attached to the cable that in turn was attached to the capstan 164. The gear motor 154 speed was then increased to slightly above the rotational speed required to extrude the wire at the predetermined rate controlled by the capstan rotational speed. This action was followed by raising the torque applied to the drive wheel by increasing the voltage to the magnet clutch 155 with a control signal to the power supply 157 to achieve a the force reading on load cell 161 just under the force required for extrusion. Finally, the capstan 164 rotation was started and raised to the desired extrusion rate by adding a relatively small drawing stress, typically about 20% of the total stress in the wire require for extrusion. This added uniaxial tensile stress from the capstan aided the uniaxial compression stress from the drive wheel in moving the wire 151 through the extrusion die in assembly 159. Near the end of the extrusion trial, once the trailing end of the wire was well through the set of pressure rollers 16*a* through 16*o* in FIG. 1, the gripping capability of the apparatus diminished and the uniaxial compression stress in the wire dropped. This drop in compression stress caused the tensile drawing stress applied to the wire by the capstan to be increased. Once the trailing end of the wire had left the "V" groove in drive wheel 17**, the rotating capstan provided the tension in the wire to draw it through the wire reduction die.

The wire for extrusion was commercial 0.051 inch diameter unalloyed copper wire with an estimated work hardened yield strength of 59,000 psi. The wire was prepared by cleaning it in a phosphoric acid solution after which it was rinsed and dried. The extrusion die opening was 0.0478 inches and had a semi-cone angle of 2.5 degrees. The extrusion area reduction was 10%. It was determined in a separate experiment that the force to push this wire through the solid beeswax in the lubrication zone was five pounds force. Following the practice described above, the beeswax lubricant was pressurized until the beeswax filled the cavity 101 within the entrance guide 103 shown in FIG. 6. The copper wire was fed into the "V" groove of the 8 inch diameter drive wheel and advanced by rotating the drive wheel until the wire contacted the extrusion die 41 causing a force reading on load cell 161(FIG. 9). Next, about 5 inches in length of the wire was extruded with a force of 28 pounds equaling a uniaxial compression stress of 14,000 psi and the then the applied extrusion force decreased. A pulling cable with one end fixed to the capstan was attached to the forward end of the copper wire. The rotating speed of the gear motor was set to turn the drive wheel at a speed limit of up to 5 RPM. By adjusting the voltage to the magnetic clutch, the pushing force exerted on the wire by the drive wheel was increased until the wire force against the extrusion die was 19 pounds as indicated by load cell 161 without any drive wheel rotation. The capstan rotation was initiated and its rotational speed was raised to pull the wire with an additional 9 pounds force at a speed of 6 feet per minute so the total force measured by load cell 161 was 28 pounds and the wire was extruded through the die. After two minutes, the extrusion die reduced a length of 12 feet of wire. The trailing end of the wire left the "V" groove of the drive wheel causing the pulling force exerted on the wire by the capstan to increase to 30 pounds, which includes the lubricating beeswax drag on the wire, until at trailing end of the wire was pulled through the reduction die.

Example 2

Using the apparatus and procedures described in relation to Example 1, two different copper clad, multi sub-element Niobium-Tin composite core wires were reduced in multiple reductions by continuous wire extrusion. For both composite wires, approximately 50% of the total cross sectional areas were the copper cladding. No wire breakage occurred during the extrusion processing. The experimental parameters are summarized below:

| | Sample A | Sample B |
|---|---|---|
| No. of core sub-elements: | 61 | 19 |
| Estimated yield strength, psi: | 102,000 | 131,000 |
| Starting Diameter, mm: | 1.25 | 1.40 |
| No. of ~5% AR reductions: | 18 | 23 |
| Final diameter, mm: | 0.80 | 0.80 |
| Final length extruded, m: | 10 | 10 |

Example 3

Numerous wire extrusion experiments, that were used to evaluate lubricants, were carried out using commercial spring hard, phosphor bronze wire with an initial diameter of 0.051 inches and estimated yield strength of 192,000 psi. Wire lengths varied from 3 feet to 10 feet and the reduction dies were either 5% or 10% area reduction. With good lubrication using a beeswax derivative, the extrusion pressure for a 5% area reduction was 38 pounds or a uniaxial compression stress of 19,000 psi. However, in the case of testing a poor lubricant with a 10% area reduction, axial forces applied to the wire by the drive wheel were up to 150 pounds that produced a uniaxial compression stress in the wire of 75,000 psi. This result was presented to show the level of gripping capability of the drive wheel described in EXAMPLE 1 using 15 pounds force applied to the wire by each pressure roller for fifteen pressure rollers with 10 pounds axial force gripping capacity per gripping station.

Figure 15:
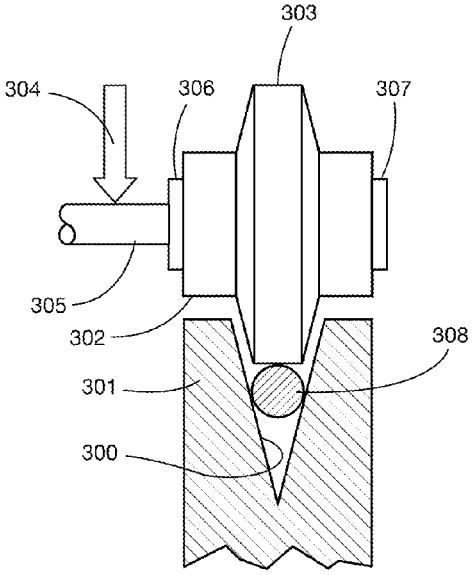
FIG. 15 is a fragmentary view, partially in section of an alternate embodiment of the apparatus of the present invention.

FIG. 15 shows an alternate embodiment to the apparatus of this invention useful for processing relatively large diameter wires. Referring to FIG. 15 a deeper than previously described "V" groove 300 in a relatively large drive wheel is used along with ridges 303 added to modify all of the pressure rollers 16*a* through 16*o* in FIG. 1 into an alternative pressure roller 302 configuration. The "V" groove 300 in the drive wheel 301 is deep enough to accommodate a large range of wire diameters. The largest diameter wire 308 can have a diameter approximately equal to the widest opening of the "V" groove. The smallest diameter can be in the approximate range from ¼ to ½ the size of the largest diameter wire depending on the wire's buckling risks due to the longer unsupported length of the wire leaving the "V" groove 300 as the wire diameter becomes smaller. In conjunction with this groove design feature, the center portion of the pressure roller 302 has been raised to form a ridge 303 that will transmit force 304 through shaft 305, to bearings 306 and 307, to pressure roller 302 and to wire 308. Whether the surface of said wire protrudes above or drops below the peripheral surface of drive wheel 301, the pressure roller ridge 303 will be narrow enough to follow a wire into a groove and wide enough to make the proper narrow line contact with wire 308. While this design change may be a good tradeoff of reducing the drive wheel cost vs. the added pressure roller cost, it complicates the guide roller section design of the apparatus. Also, the wire diameter must be large enough to reduce the possibility of buckling of the wire as it rises out of the "V" groove with a longer span without lateral support. Typically the smallest diameter wire should be at least 1/16 inches.

Figure 16:
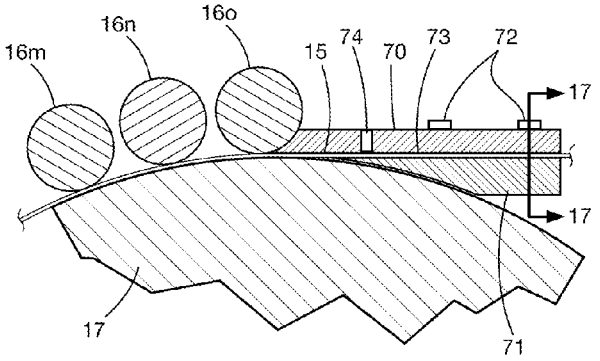
FIG. 16 is a fragmentary cross-sectional view of an alternate embodiment of the inlet guide according to the present invention.
Figure 17:
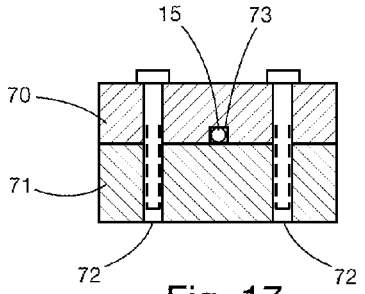
FIG. 17 is a view taken along line 17-17 of FIG. 16.

FIG. 16 shows another alternate embodiment to the apparatus of the present invention that may be a preferred practice for larger diameter wire by using a stationary channel 73 to replace the guide rollers that are shown as components 33*a* through 33*j* in FIG. 1. Said stationary channel 73 transversely supports and guides the moving wire away from the drive wheel 17 to the Wire Processing Device. The friction drag on the moving wire surface due to rubbing on the stationary channel walls will have a reduced influence on diminishing the high uniaxial compression stress in the wire due to lowering the wire surface area to cross section area ratio as the wire diameter increases. In applications for which the distance from where the wire 15 leaves contact with the drive wheel 17 to where it contacts the Wire Processing Device is relatively short, using the stationary channel may be practical. FIG. 16 shows wire 15 entering the guide channel 73 immediately after the wire 15 leaves contact with pressure roller 16*o*. As one example of many possible construction choices, the guide channel 73 is formed by the groove in upper plate 70 and the surface of lower plate 71 when the two plates are held together my fasteners 72 as seen in FIG. 17. This two component design allows upper plate 70 to be removed for cleaning the channel or changing the channel size. Lubricant in the form of grease or wax may be injected through port 74 at a rate sufficient to lubricate moving wire 15 in channel 73, but at a rate that does not allow the lubricant to flow out of the channel entrance to contaminate the drive wheel. The guide channel 73 is shown as straight, but may be curved with a relatively large radius wire path. Also, guide channel 73 is shown in a horizontal orientation; however, the orientation of the direction of the wire moving away from the apparatus can be chosen in other orientations for convenience. The approach angle of the wire to the apparatus will depend on the wire exit orientation, the number of pressure rollers and the geometry of the wire exit guidance system that, in combination, dictate the relationship of the angle between the wire's approach and wire's exit paths.

The alternate embodiments of the invention described above are used to adapt the invention to processing larger wire diameters in order to optimize cost to performance balance of the apparatus. Other application changes such as the nature of the Wire Processing Device or whether the apparatus application is for R&D, production or manufacturing may cause other modifications to the apparatus to be attractive that will become evident to one skilled in the art of machine design.

Figure 18:
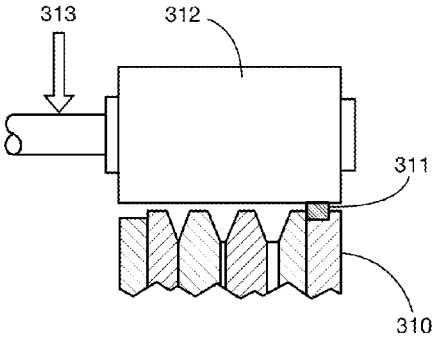
FIG. 18 is a fragmentary view, partially in section illustrating use of an apparatus according to the present invention to push wire having a rectangular cross-section.

The following disclosure illustrates some of many other modifications to the present invention that are within the scope of the present once the foregoing disclosure is read by those skilled in the art:

1. Referring to FIG. 1, grooves are added to the outer curved surface wire support wedge 49; said grooves are designed to provide the lateral support to moving wire 15 and are sized accordingly; the grooves in said guide rollers 33*a* through 33*j* will be omitted. Referring to FIG. 1, the "V" groove in drive wheel 17 may be replaced by a rectangular or "U" shaped groove so the wire 15 is forced against the drive wheel 17 by the pressure rollers 16*a* through 16*o* with a single line contact. In comparison to the "V" groove design, this modification reduces the contact force between said wire 15 and drive wheel 17 for a given value of force applied to the wire by a pressure roller. Thus the number of pressure rollers must be increased to grip and drive the round cross section wire 15 to achieve an equivalent axial compression stress to that obtained using the "V" groove. The wire gripping capability of a pressure roller pushing the wire in contact with the drive wheel depends on the surface shear stress obtained by the contact pressure and coefficient of friction between the wire and the drive wheel at the contact surface. The gripping capacity limit depends on the amount of force that can be applied to the wire by the pressure roller without damaging the wire. In the case of the round wire, the contact area is limited to a very small area in which the theoretical "point contact" between cylinders with crossed axes is expanded due to elastic deflection plus some tolerated plastic deformation. Once the pressure roller diameter has been established, tests for wire damage as a function of pressure roller applied force can be conducted for wire sizes and wire material strength to establish the maximum allowable applied force and therefore gripping capacity limits for a given "V" groove wall angle. If a "U" shape or rectangular groove is used in the drive wheel, the gripping limit for a round wire drops substantially due to the reduced contact force obtained with the mechanical advantage provide with the "V" shape groove. In the case of a rectangular wire, a much higher pressure roller force can be applied to the wire due to the much larger bearing area of the roll on the flat contact surface of the rectangular wire. Therefore, the pressure roller and drive wheel combination will be very effective in creating high axial compression stress in rectangular section wires. As a result, very little investment is required to incorporate the capability to process rectangular wire with minor modifications to the apparatus shown in FIG. 1. The construction of the drive wheel 17 shown in FIG. 2 can be modified to add a rectangular groove as shown in FIG. 18. Referring to FIG. 18, a step in the diameter of the periphery of disc 27 shown in FIG. 2 resulted in part 310 to provide the rectangular groove for wire 311 while pressure roller 312*j* pushed the wire against the drive wheel surface with appropriately increased force 313. Correspondingly, the guide rollers show in FIG. 3 must be extended in width and a rectangular groove added to each guide roller for wire 311 up to the entrance of the wire processing device.

2. Referring to FIG. 1, the "V" groove in drive wheel 17 may be omitted and corresponding "V", "U", or rectangular grooves are added to the pressure rollers 16*a* through 16*o*; said pressure roller grooves are designed to provide the lateral support to moving wire 15 and are sized accordingly. This modification reduces the contact force between said wire 15 and drive wheel 17 for a given value of force applied to the wire by each pressure roller. Thus the number of pressure rollers must be increased to grip and drive the wire 15 to achieve an equivalent axial compression stress to that obtained using the FIG. 1 "V" groove design.

3. Referring to FIG. 1, wire 15 can be move along a compound arc path and out to the plane of the drive wheel 17 after leaving contact with the drive wheel immediately beyond pressure roller 16*o*. This modification can be achieved by:

(a) progressive rotation in orientation of the rotational axes of each of the guide rollers 33*a* through 33*j* in the planes passing through both the drive wheel axis and the guide roller axes; and (b) progressive shifts in lateral position of the guide rollers out of the plane of the drive wheel 17. This variation in design will add complexity to mounting of the guide rollers and the fabrication of the wire support wedge 49.

This design modification would have to offer some special benefit in order to justify its added cost.

The unique combination of features that characterize the present invention, and differentiate the present invention from the prior art are that:

(1) the moving wire is pressed against the periphery of a single, relatively large drive wheel over the long span of distance at multiple locations needed to build up the high level of axial compression stress due to a remotely located resistance to the wire's motion; and (2) the moving wire separates from the drive wheel and travels some distance in a state of high, substantially axial compression stress before encountering the wire processing operation that provides resistance to the wire's movement.

Feature (1) distinguishes the invention from the pinch roller wire feeding systems and feature (2) distinguishes the invention from prior art processes described as "Conform, Linex, Extrolling" and hydrostatic extrusion.

The wire delivery system described above has provided for wire processing capabilities never before possible. The continuous open die wire extrusion on an industrial scale provide a way to counteract the damaging adverse residual stress pattern common to wire drawing of complex composite such as those found in advanced superconductors. The higher uniaxial compression stress available with this invention increases the range of deformation possible in abutment type wire bending into various configurations such as springs. It will also be shown how the wire delivery system can be used to uniaxially compress shape memory alloy (SMA) wire with large, 5% to 10% strains, in its martensite state to create a new form of SMA wire product. Another use of the invention is to use it to push wire into a pressure chamber assembly for hydrostatic extrusion processing over a wide temperature range.

Having thus described my invention what is desired to be secured by Letters Patent of the United States is set forth in the appended claims:

What is claimed is:

1. A method for applying uniaxial compression stresses to a solid moving wire comprising the steps of:

moving said wire along an arcuate path;

applying axial force at multiple gripping locations along the surface of the wire as it is moved along said arcuate path;

providing resistance to said wire moving along said arcuate path said resistance provided by a remotely located wire deformation processing device in combination with said axial force on said moving wire to cause high uniaxial compression stresses in said wire and;

moving said uniaxially compressed wire without additional axial force applied to said wire whereby said wire is supported from buckling as it moves along a guided path to said remotely located wire deformation processing device.

2. A method according to claim 1, including the step of using open die extrusion as said remotely located wire deformation processing device to provide resistance.

3. A method according to claim 1, including the step of using hydrostatic extrusion of said wire as said remotely located wire deformation processing device to provide resistance.

4. A method according to claim 3, including the step of operating said hydrostatic extrusion at elevated temperature.

5. A method for extrusion of a solid composite wire having a core and cladding with an interface between said core and said cladding, said composite wire having a residual stress pattern that causes a potentially damaging high shear stress at the said interface between said core and said cladding comprising the steps of:

applying axial compression stresses to said wire prior to entering an extrusion apparatus having an extrusion die, said compression stresses applied at a level to reduce said high shear stress at said interface to a non-damaging low interface shear stress, and moving said composite wire with said non-damaging low interface shear stress through said extrusion die.

* * * * *